US007468700B2

(12) United States Patent
Milosavlejevic

(10) Patent No.: US 7,468,700 B2
(45) Date of Patent: Dec. 23, 2008

(54) ADJUSTABLE MULTI-BAND ANTENNA

(75) Inventor: Zlatoljub Milosavlejevic, Kempele (FI)

(73) Assignee: Pulse Finland Oy, Kempele (FI)

( * ) Notice: Subject to any disclaimer, the term of this patent is extended or adjusted under 35 U.S.C. 154(b) by 350 days.

(21) Appl. No.: 11/008,447

(22) Filed: Dec. 9, 2004

(65) Prior Publication Data

US 2005/0128152 A1 Jun. 16, 2005

(30) Foreign Application Priority Data

Dec. 15, 2003 (FI) ..... 20031833

(51) Int. Cl.
*H01Q 1/24* (2006.01)

(52) U.S. Cl. ..... 343/702; 343/700 MS; 343/850

(58) Field of Classification Search ..... 343/700 MS, 343/745, 829, 846, 850, 702, 876
See application file for complete search history.

(56) References Cited

U.S. PATENT DOCUMENTS

| | | | | |
|---|---|---|---|---|
| 5,585,810 | A * | 12/1996 | Tsuru et al. | 343/745 |
| 5,874,926 | A * | 2/1999 | Tsuru et al. | 343/860 |
| 6,255,994 | B1 * | 7/2001 | Saito | 343/700 MS |
| 6,353,443 | B1 * | 3/2002 | Ying | 715/702 |
| 6,462,716 | B1 * | 10/2002 | Kushihi | 343/860 |
| 6,693,594 | B2 * | 2/2004 | Pankinaho et al. | 343/700 MS |
| 6,825,818 | B2 * | 11/2004 | Toncich | 343/860 |
| 6,836,249 | B2 * | 12/2004 | Kenoun et al. | 343/700 MS |
| 6,975,278 | B2 * | 12/2005 | Song et al. | 343/795 |

FOREIGN PATENT DOCUMENTS

| | | | |
|---|---|---|---|
| EP | 0 400 872 | A1 | 12/1990 |
| EP | 1 052 723 | A2 | 11/2000 |
| EP | 1 113 524 | A2 | 7/2001 |
| FI | 113588 | B | 11/2000 |
| JP | 10 28013 | | 1/1998 |
| JP | 10 224142 | | 8/1998 |
| JP | 2001 53543 | | 2/2001 |
| WO | WO-02/11236 | | 2/2002 |
| WO | WO-02/067375 | A1 | 8/2002 |
| WO | WO-02/078124 | A1 | 10/2002 |

OTHER PUBLICATIONS

Examination Report dated May 3, 2006 issued by the EPO for European Patent Application No. 04 396 079.8.

* cited by examiner

*Primary Examiner*—Douglas W. Owens
*Assistant Examiner*—Jimmy T Vu
(74) *Attorney, Agent, or Firm*—Darby & Darby P.C.

(57) ABSTRACT

An adjustable multi-band planar antenna especially applicable in mobile terminals. A conductive element is placed in the structure of an antenna of PIFA type such that the conductive element has a significant electromagnetic coupling to the radiating plane. The parasitic element at issue is connected to a matching circuit (550) consisting of several reactive element. The parasitic element, the matching circuit and a line (540) between them constitute an adjusting circuit of the antenna. The circuit values of the matching circuit can be chosen from at least two alternatives. Alteration in the circuit values changes the coupling between the parasitic element and the ground, in which case an operation band of the antenna is displaced, because the electric length of the antenna's part corresponding that band is changed, measured from the short-circuit point. Regarding the shiftable operation band, proper impedance matching and a proper efficiency can be arranged for the antenna.

10 Claims, 5 Drawing Sheets

ADJUSTABLE MULTI-BAND ANTENNA

The invention relates to an adjustable multi-band planar antenna especially applicable in mobile terminals. The invention further relates to a radio device equipped with that kind of antenna.

BACKGROUND OF THE INVENTION

The adjustability of an antenna means in this description, that a resonance frequency or resonance frequencies of the antenna can be changed electrically. The aim is that the operation band of the antenna around a resonance frequency always covers the frequency range, which the function presumes at a given time. There are different grounds for the adjustability. As portable radio devices, like mobile terminals, are becoming smaller thickness-wise, too, the distance between the radiating plane and the ground plane of an internal planar antenna unavoidably becomes shorter. A drawback of the reducing of said distance is that the bandwidths of the antenna become smaller. Then, as a mobile terminal is designed to function in different radio systems having frequency ranges relatively close to each other, it becomes more difficult or impossible to cover frequency ranges used by more than one radio system. Such a system pair is for instance GSM1800 (Global System for Mobile telecommunications) and GSM1900. Correspondingly, securing the function that conforms to specifications in both transmitting and receiving bands of a single system can become more difficult. When the system uses sub-band division, it is advantageous if the resonance frequency of the antenna can be tuned inside sub-band being used at a given time, from the point of the radio connection quality.

A known way to adjust an antenna is the use of switches. For example a solution presented in FIG. 1 is known from the application publication FI 20021555. The basis of the solution is that a parasitic conductive element is connected to the ground by a switch. The antenna is a dual-band PIFA. The radiating plane 120 has a slot 125, which starts from an edge of the plane next to the short point S and ends at inner region of the plane. The slot 125 has such a shape that the radiating plane, viewed from the short point, is split into two branches. The first branch 121 skirts along edges of the plane and surrounds the second, shorter branch 122. The first branch together with the ground plane resonates on the lower operation band of the antenna and the second branch together with the ground plane in the upper operation band. The radiating plane 120 is a fairly rigid conductive plate, or metal sheet, being supported by a dielectric frame 180 to the radio device's circuit board 101 below the radiating plane. The conductive upper surface of the circuit board 101 functions as the ground plane 110 of the antenna and at the same time as the signal ground GND. The short-circuit conductor 111 and the feed conductor 112 are of spring contact type and the one and the same piece with the radiating plane.

A parasitic conductive strip 130 is in FIG. 1 attached or otherwise provided on a vertical outer surface of a dielectric frame 150, on that side of the antenna, where the feed conductor and the short-circuit conductor are located. The conductive strip 130 is in that case below the electrically outermost portion of the first branch 121, for which reason the connection of the conductive strip effects more strongly on the place of the antenna's lower operation band than on the place of the upper operation band. The switching arrangement is shown in FIG. 1 only by graphic symbols. The parasitic element 130 is connected to a switch SW, the second pole of which is connected to the signal ground through a component 150. The impedance of that component can be utilized, if desired displacements of operation bands can not be obtained merely by selecting the place of the parasitic element. The impedance is reactive, either purely inductive or purely capacitive; a resistive part is out of the question due to dissipations caused by it. In a special case the component 150 is a pure short circuit.

FIG. 2 shows an example of the effect of the parasitic element on antenna's operation bands in structures as described above. The operation bands appear from curves of the reflection coefficient S11 of the antenna. Curve 21 shows alteration of the reflection coefficient as a function of frequency, when the parasitic conductive strip is not connected to the ground, and curve 22 shows alteration of the reflection coefficient as a function of frequency, when the conductive strip is connected to the ground. When comparing the curves, it will be seen that the lower operation band is shifted downwards and the upper operation band upwards in the frequency axis. The frequency $f_1$, or the centre frequency of the lower band for a start, is for instance 900 MHz and it's displacement $\Delta f_1$ is for instance −20 MHz.

The frequency $f_2$, or the centre frequency of the band for a start, is for instance 1.73 GHz and it's displacement $\Delta f_2$ is for instance +70 MHz.

In the structures such as shown in FIG. 1, the adjusting of a multi-band antenna is obtained by means of additive components, which do not presume changes in the antenna's basic structure. The parasitic element is placed on a surface of a dielectric part, which is needed in the antenna structure in any case. However a flaw of that solution is, that there are only relatively limited possibilities to arrange both a proper impedance matching and a proper efficiency for the antenna. Moreover, if the influence of the use of the switch is desired to be limited only to certain operation band, keeping another operation band in its place can be difficult, in practice.

Instead of a discrete component, after the switch there can be a transmission line, implemented by the circuit board and being short circuited or open at the other end. The impedance of that kind of transmission line changes in a known way, when its length is changed. If the line's length is chosen just right, the antenna is provided with a desired displacement of an operation band. Using a multi-pole switch and several transmission lines, the operation band has corresponding number of alternative places. A transmission line in that kind of arrangement can be unpractically long so that it takes up remarkably the area of the circuit board.

SUMMARY OF THE INVENTION

An object of the invention is to alleviate the above-mentioned drawbacks associated with the prior art. An adjustable multi-band antenna according to the invention is characterized in that which is specified in the independent claim 1. A radio device according to the invention is characterized in that which is specified in the independent claim 10. Advantageous embodiments of the invention are presented in the dependent claims.

The basic idea of the invention is as follows: In the structure of an antenna of PIFA type a conductive element having a significant electromagnetic coupling is placed to the radiating plane. The parasitic element at issue is connected to a matching circuit consisting of several reactive elements. The parasitic element, the matching circuit and a line between them constitute an adjusting circuit of the antenna. The circuit values of the matching circuit can be chosen from at least two alternatives. Alteration in the circuit values changes the coupling between the parasitic element and the ground, in which case an operation band of the antenna is displaced, because the electric length of the antenna's part corresponding that band is changed, measured from the short-circuit point.

An advantage of the invention is that, regarding the operation band that has to be shiftable, possibilities to arrange both a proper impedance matching and a proper efficiency for an antenna are better than in the known solutions. This is due to that there are several variables, when designing the reactive matching circuit. An optimum for the matching circuit then can be searched in a large range. Another advantage of the invention is that, if needed, the influence of the adjusting can be directed only on one operation band of the antenna. A further advantage of the invention is that the adjusting circuit does not presume bulky transmission lines, in vention is that the adjusting circuit does not presume bulky transmission lines, in which case it can be implemented in relatively small size.

BRIEF DESCRIPTION OF THE DRAWINGS

The invention is below described in detail. Reference will be made to the accompanying drawings where.

DETAILED DESCRIPTION OF THE INVENTION

Figure 1:
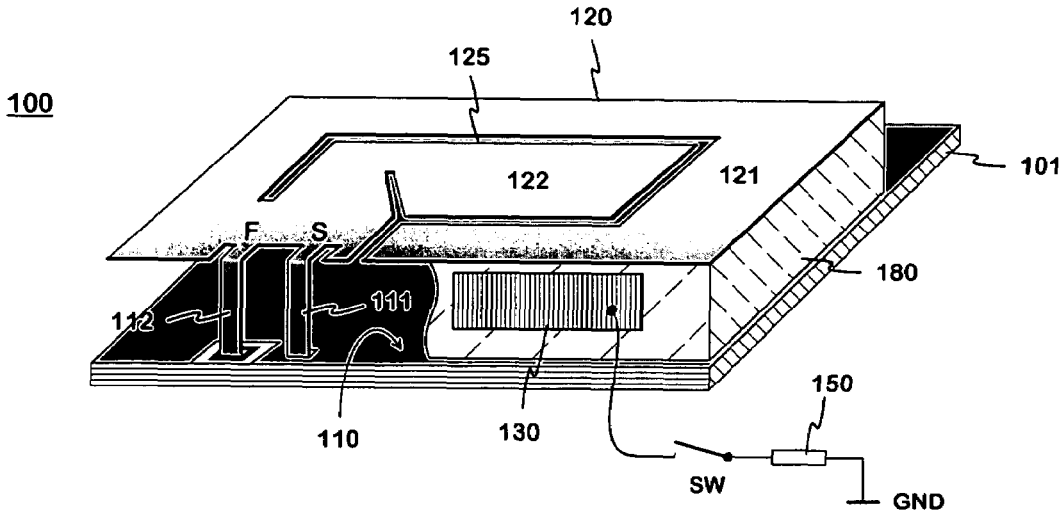
Fig. 1 PRIOR ART
FIG. 1 shows an example of an adjustable antenna according to the prior art.
Figure 2:
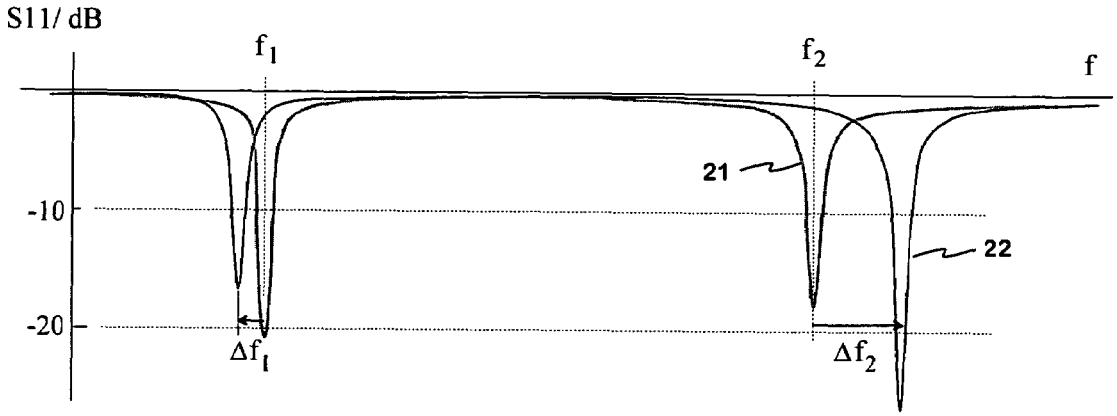
Fig. 2 PRIOR ART
FIG. 2 shows an example of the effect of an arrangement according to the prior art on antenna's operation bands.

FIGS. 1 and 2 were already described in conjunction with the description of the prior art.

Figure 3:
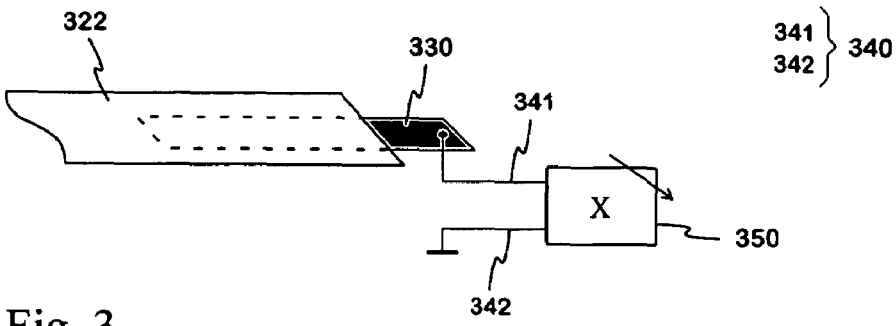
FIG. 3 shows the principle of the invention.

FIG. 3 presents a structure presents the principle of the invention. From the antenna's PIFA type base structure only part 322 of the radiating plane is drawn. The antenna structure comprises, in addition to the base structure, an adjusting circuit having a parasitic element 330 of the radiating plane, a transmission line 340 and a matching circuit 350. The transmission line, having a first conductor 341 and a second conductor 342, is very short in practice, for saving the space. The starting end of the first conductor is connected to the parasitic element and the starting end of the second conductor to the ground. The matching circuit 350 is connected between the tail ends of the conductors of the transmission line. In practice the second conductor 342 can be included in the ground plane, which does not, as such, have starting and tail ends. The impedance X of the matching circuit is quite purely reactive. The matching circuit is adjustable so that its circuit values can be altered. When the circuit is adjusted, the electrical length of the antenna part, which corresponds to the desired operation band, is changed. Said electrical length is measured in the short-circuit point of the antenna. At the same time changes corresponding resonance frequency, of course. The alternative circuit values are chosen such that desired alternative places are obtained for the operation band at issue.

Figure 4:
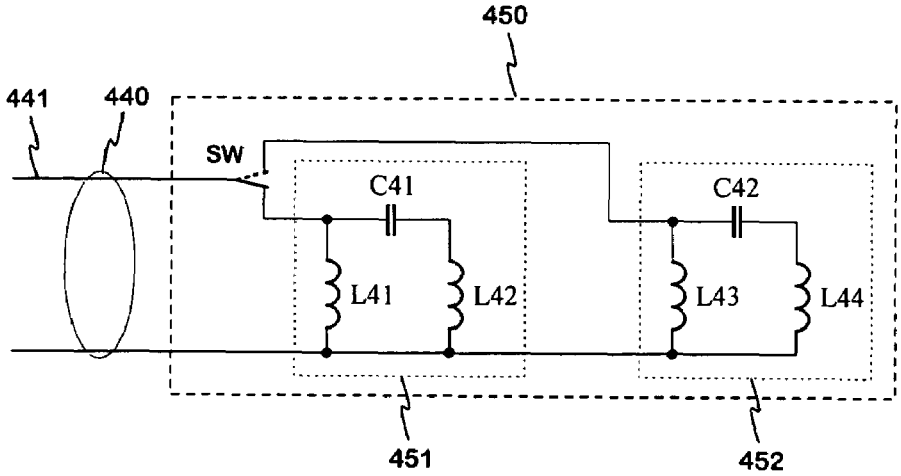
FIG. 4 shows an example of a reactive circuit included in a matching circuit of an antenna according to the invention.

FIG. 4 shows an example of a matching circuit being included in the adjusting circuit of an antenna according to the invention. The matching circuit 450 comprises a first reactive circuit 451, a second reactive circuit 452 and a two-way switch SW. The first conductor 441 of the transmission line 440 is fixedly connected to the common pole of the two-way switch. One of the changeover poles is fixedly connected to the first terminal of the first reactive circuit and the other of the changeover poles is fixedly connected to the first terminal of the second reactive circuit. The second terminals of both reactive circuits in turn are fixedly connected to the second conductor of the transmission line. So one of the reactive circuits is connected to the transmission line 440 at a time, depending on the state of the switch SW. Thus the altering of the circuit values is in this example implemented by controlling the switch. The first reactive circuit 451 constitutes a parallel circuit, one branch of which comprising a coil L41 and another branch of which comprising a condenser C41 and a coil L42 in series. This kind of reactive circuit is inductive in low frequencies, in an intermediate range capacitive and upwards thereof again inductive. In the lower boundary of the intermediate range the reactive circuit has a parallel resonance, in which case its magnitude is very high, and in the upper boundary of the intermediate range the reactive circuit has a serial resonance, in which case its magnitude is very low. The second reactive circuit 452 is similar in structure as the first reactive circuit: It has a coil L43 and parallel with this coil a condenser C42 and a coil L44 in series.

The switch SW in FIG. 4 is a two-way switch, or a SPDT switch (single-pole double through). The matching circuit can include only one reactive circuit, in which case that reactive circuit or nothing is connected to the transmission line. Then a close switch, or a SPST switch (single-pole single through) is enough. The switch can further be a SPnT switch (single-pole n through) for connecting several alternative reactive circuits. For the method of implementation the switch SW is e.g. a semiconductor component or a MEMS type switch (Micro Electro Mechanical System).

Figure 5:
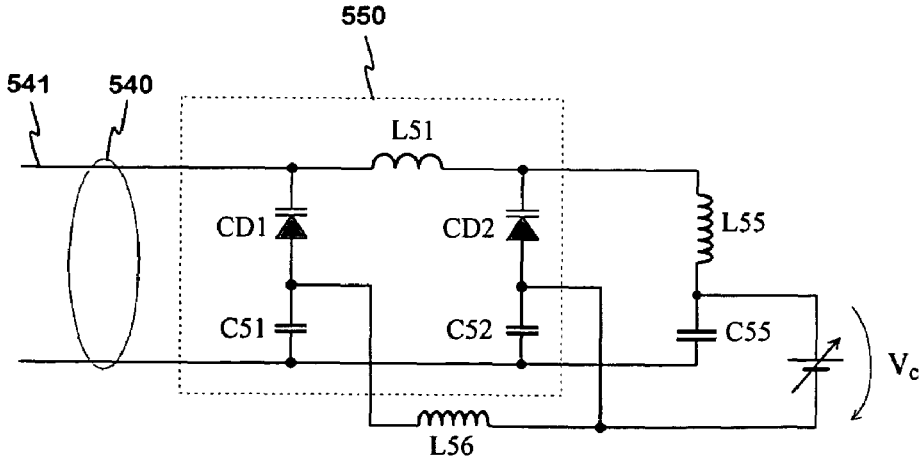
FIG. 5 shows another example of a reactive circuit included in a matching circuit of an antenna according to the invention.

FIG. 5 shows another example of a matching circuit being included in the adjusting circuit of an antenna according to the invention. The reactive matching circuit 550, connected between the conductors of the transmission line 540, constitutes a parallel circuit, one branch of which is quite purely capacitive. It has a first capacitance diode CD1 and a condenser C51 in series. Another branch of the parallel circuit has a coil L51, a second capacitance diode CD2 and a condenser C52 in series. The second terminals of the condensers C51 and C52 then are connected to each other and to the second conductor of the transmission line. That second conductor is a part of the signal ground. In low frequencies the reactance of the matching circuit 550 is capacitive, in an intermediate range inductive and upwards thereof capacitive again. In the lower boundary of the intermediate range the matching circuit has a serial resonance, in which case the magnitude of its impedance is very low, and in the upper boundary of the intermediate range the matching circuit has a parallel resonance, in which case the magnitude of its impedance is very high. In this example the altering of the circuit values is implemented by changing the reverse voltage and thus the capacitance of the capacitance diodes. The reverse voltage, or the control voltage $V_c$ of the capacitance diodes, is provided by a suitable direct voltage source. The control voltage can be continuously adjustable, in which case the number of circuit values of the matching circuit is infinite, in principle. In practice, if a certain operation band has to be displaced between some specified places, the control voltage $V_c$ is generated e.g. by a multipole switch and a resistive voltage divider. It depends on the state of the multi-pole switch, which voltage dividing ratio is currently effective.

That the relatively low impedance of the direct voltage source and the possible voltage dividing circuit should not change the impedance of the matching circuit, the control voltage circuit comprises a coil L55, in series when starting from the positive pole of the voltage source. The impedance of that coil is very high at the frequencies occurring in the matching circuit. The same control voltage $V_c$ affects over both capacitance diodes. That the anodes of these diodes should not be short-circuited to each other at the operating frequencies, there is a coil L56 having a very high impedance at said frequencies between the anodes. To equalize the control voltage of the capacitance diodes the circuit further comprises a con denser C55 connected between the positive pole of the voltage source and the signal ground.

Figure 6:
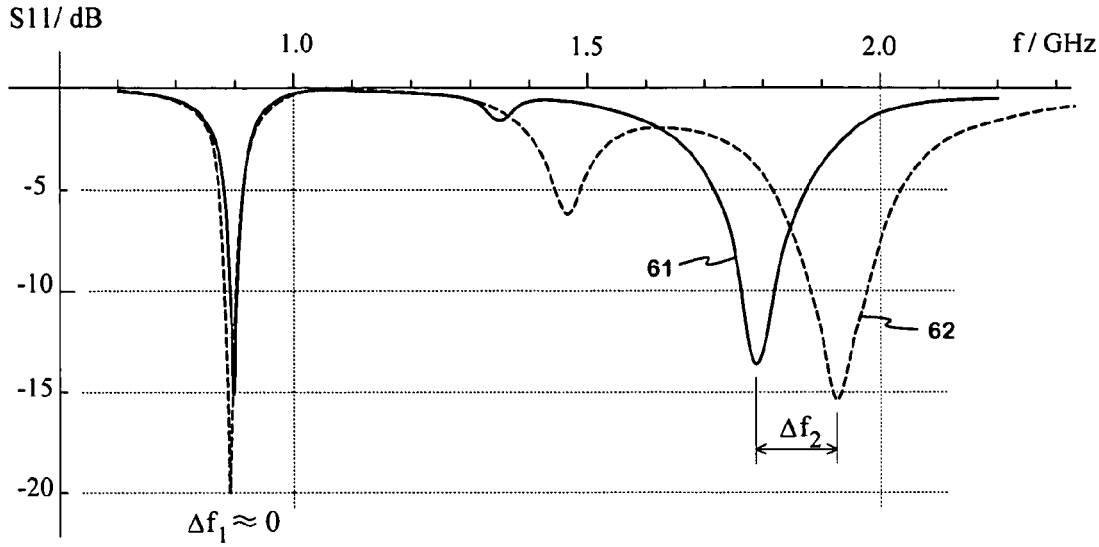
FIG. 6 shows an example of displacement of operation bands of an antenna according to the invention.

The matching circuits according to FIGS. 4 and 5 are suitable for use for instance in dual-band antennas, the upper operation band of which must be shiftable. FIG. 6 shows an example of a result when using a circuit according to FIG. 4. Regarding the first reactance 451, the capacitance C41 is 2.4 pF, inductance L41 12.8 nH and inductance L42 6.1 nH. Regarding the second reactance 452, the capacitance C42 is 1.9 pF, inductance L43 10.3 nH and inductance L44 4.9 nH. Curve 61 shows alteration of the reflection coefficient as a function of frequency when the reactance 451 is connected to the transmission line, and curve 62 shows alteration of the reflection coefficient when the second reactance 452 is connected to the transmission line. When comparing the curves, it will be seen that the upper operation band, placed in a range of 1.8 GHz, is in the latter case displaced upwards. The displacement $\Delta f_2$ is about 140 MHz. Displacing upwards means that the electric length of the antenna's part at issue has become shorter. This is consequence of that the inductive reactance provided from the radiating plane to the ground through the parasitic element has become higher. The lower operation band in a range of 900 MHz stays in its place in the accuracy of few megaherzes. This is due to that the magnitude of both reactances is very high at the frequencies of the lower operation band. It is easier, if the coupling between the parasitic element and that part of the radiating plane that corresponds to the lower band is weak.

Figure 7:
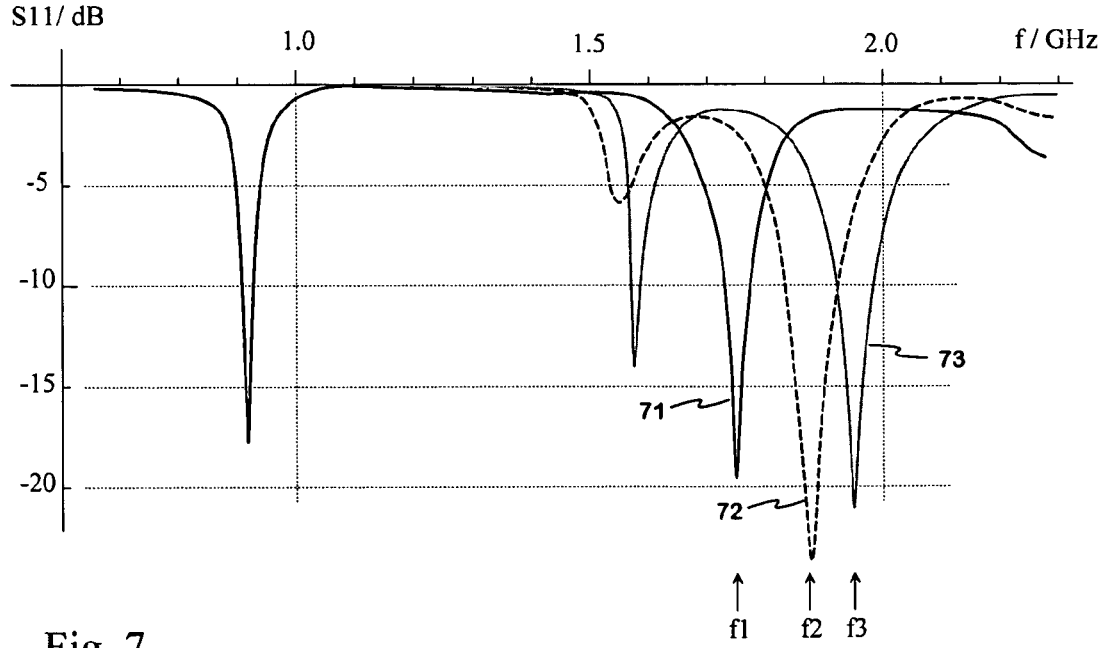
FIG. 7 shows another example of displacement of operation bands of an antenna according to the invention.

FIG. 7 shows an example of displacements of the operation bands when using a matching circuit according to FIG. 5. The inductance L51 is 3.9 nH and the both capacitances C51 and C52 0.5 pF. Curve 71 shows alteration of the reflection coefficient as a function of frequency when the control voltage of the capacitance diodes CD1 and CD2 is 2.37V, curve 72 shows alteration of the reflection coefficient when the control voltage is 3.83V and curve 73 shows alteration of the reflection coefficient when the control voltage is 4.75V. These control voltages correspond to capacitance values about 1.4 pF, 1.0 pF and 0.7 pF. When comparing the curves, it will be seen that the upper operation band, placed near the frequency 2 GHz, is displaced upwards. In the case of the curve 71 the middle frequency of the band is about 1.75 GHz, in the case of the curve 72 about 1.87 GHz and in the case of the curve 73 about 1.95 GHz. Displacing upwards means that the electric length of the antenna's part at issue has become shorter. Now this is consequence of that the capacitive reactance provided from the radiating plane to the ground through the parasitic element has become lower. The lower operation band in a range of 900 MHz stays in its place with high accuracy.

The number of the curves in FIG. 7 is three. In accordance with the description above, the steppping of operation band's place can be arbitrary dense. The operation band can for instance be set at transmitting and receiving bands of different radio systems operating in the range of 1.7-2.0 GHz.

Figure 8:
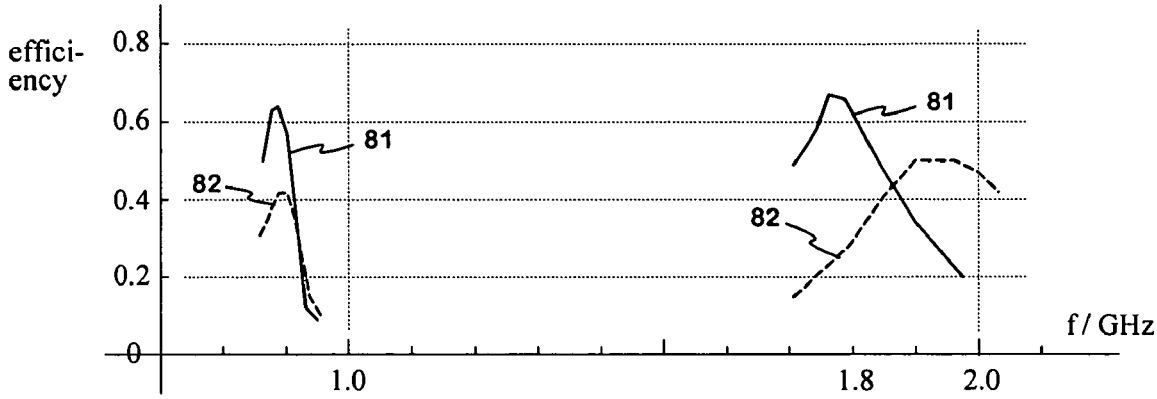
FIG. 8 shows an example of efficiency of an antenna according to the invention.

FIG. 8 shows an example of efficiency of an antenna according to the invention. The example concerns the same structure as matching curves in FIG. 6. Curve 81 shows alteration of the efficiency as a function of frequency when the reactance 451 is connected to the transmission line, and curve 82 shows alteration of the reflection coefficient when the second reactance 452 is connected to the transmission line. The efficiencies are of the order 0.4 on the average, in the former case they are to some degree better than in the latter case.

Figure 9:
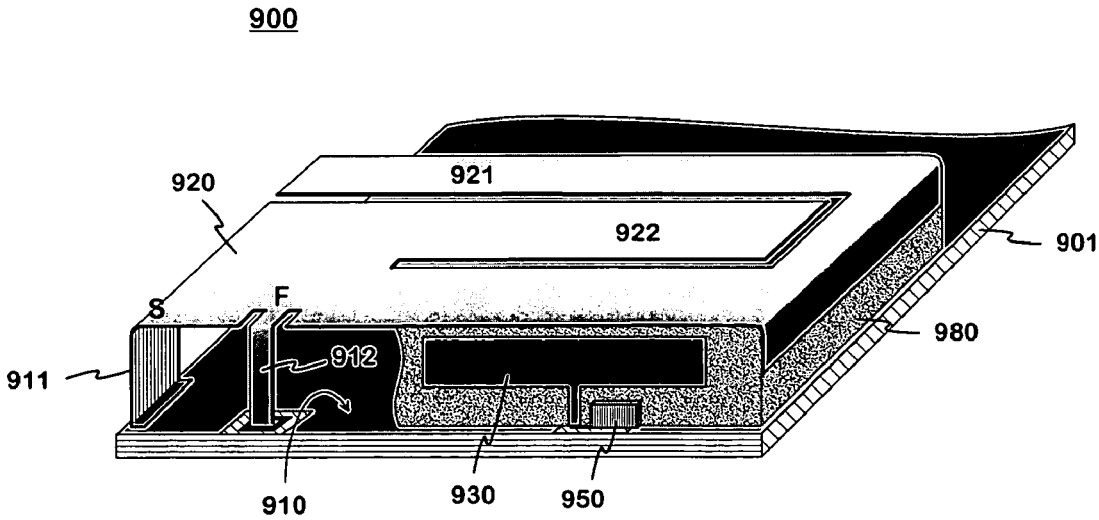
FIG. 9 shows an example of an adjustable antenna according to the invention, with its matching circuit.

FIG. 9 shows an example of an adjustable antenna according to the invention. The base structure of the antenna is a dual-band PIFA like in FIG. 1. The radiating plane 920 is divided, viewed from the short point S, into a first branch 921 and a second, shorter branch 922. The first branch together with the ground plane resonates on the lower operation band of the antenna and the second branch together with the ground plane on the upper operation band. The radiating plane is a fairly rigid conductive plate, or metal sheet, being supported by a dielectric frame 980 to the radio device's circuit board 901 below the radiating plane. The conductive upper surface of the circuit board 901 functions as the ground plane 910 of the antenna and at the same time as the signal ground GND. A strip-like parasitic element 930 is placed on a vertical outer surface of a dielectric frame 980, on that side of the antenna, where the feed conductor 912 is located. The conductive strip 930 is in that case at the starting portion of the first branch 921 and has mainly inductive coupling to the first branch. Regarding the second branch 922, the parasitic element is located at its electrically outermost portion, for which reason the coupling to the second branch is mainly capacitive. The matching circuit 950 is in this example integrated into a single component, i.e. matching component. Regarding capacitive and inductive elements, the integration is implemented e.g. by LTCC (Low Temperature Co-fired Ceramic) or FBAR (Film Bulk Acoustic Wave Resonator) technology. If the component includes a switch, that can be implemented e.g. by semiconductor or MEMS technology. The matching component is mounted on the circuit board 901, beside the dielectric frame 980 below the parasitic element 930. The transmission conductor consists of a conductor reaching from the parasitic element to the circuit board and a strip conductor on the circuit board reaching to the matching component.

The matching circuit is controlled by a control circuit being located on the lower surface of the circuit board 901, via a thru hole. The matching component could also be arranged to reach to the lower edge of the parasitic element in vertical direction such that a matching circuit pin can be connected directly to the parasitic element.

Figure 10:
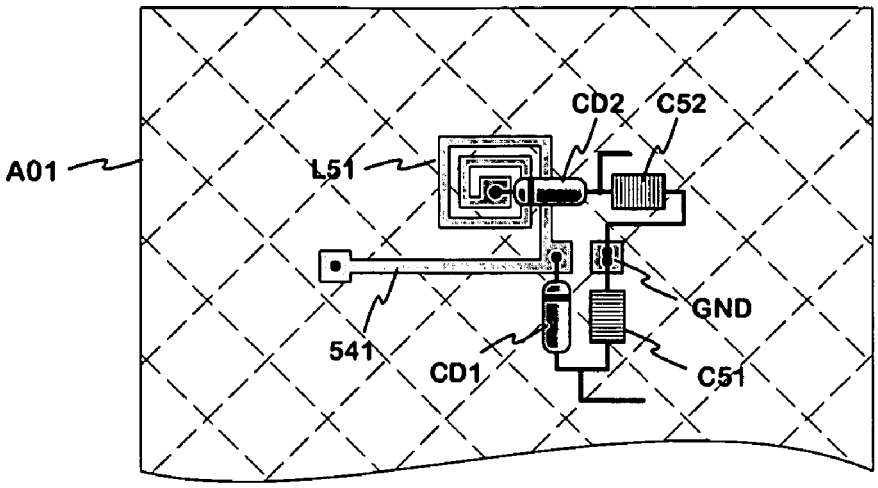
FIG. 10 shows another example of an implementation of matching circuit in an antenna according to the invention.

FIG. 10 shows another example of an implementation of matching circuit in an antenna according to the invention. The figure presents the circuit board A01 of a radio device underneath. The ground plane is then invisible, on the reverse side of the board. The matching circuit conforms to the circuit 550 in FIG. 5, for which reason same reference numbers occur in FIG. 10 as in FIG. 5. The conductor connected to the parasitic element continues as a strip conductor 541 to the matching circuit. The coil L51 is a spiral-like strip conductor on the surface of the circuit board A01. The capacitance diodes CD1 and CD2 as well as condensers C51 and C52 are discrete components. The control voltage circuit of the capacitance diodes is not shown in FIG. 10.

Figure 11:
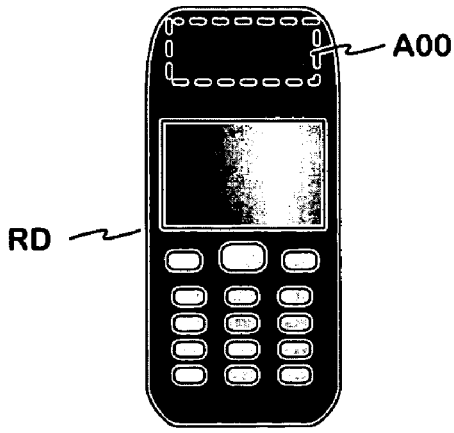
FIG. 11 shows an example of a radio device provided with an antenna according to the invention.

FIG. 11 shows a radio device RD comprising an adjustable multi-band antenna A00 according to the invention.

Prefixes "lower", "upper" and "vertical" as well as words "under" and "underneath" refer in this description and in the claims to the antenna positions depicted in the FIGS. 1 and 9, and are not associated with the operating position of the device. The term "parasitic" means also in the claims a structure part, which has a significant electromagnetic coupling to the radiating plane of the antenna.

Examples of an adjustable multi-band antenna according to the invention have been described above. The shape and the place of the parasitic element can differ from that shown in figures. The matching circuit in the adjusting circuit of the antenna naturally can be formed in many ways. For example the matching circuit in FIG. 5 can be modified so that the elements having a constant capacitance are parallel with the capacitance diodes, instead in series. The inventional idea can be applied in different ways within the scope defined by the independent claim 1.

The invention claimed is:

1. An adjustable multi-band antenna comprising:

a ground plane;

a radiating plane with a dielectric support part;

an adjusting circuit having a parasitic element electromagnetically coupled to the radiating plane; and a controllable part connected to the parasitic element, the controllable part being configured to change a coupling between the parasitic element and the ground plane to displace an operation band of the antenna;

said controllable part comprising at least one reactive matching circuit, which constitutes a parallel circuit one branch of which comprises a reactive element and another branch a capacitive and inductive element in series to optimize an impedance matching and efficiency of the antenna, circuit values of which controllable part being arranged to be chosen from at least two alternatives to implement said change in the coupling.

2. An antenna according to claim 1, having at least a lower operation band and an upper operation band, wherein said operation band to be displaced is the upper operation band.

3. An antenna according to claim 2, the matching circuit having a parallel resonance in range of the lower operation band, to limit influence of a change in said circuit values to the upper operation band.

4. An antenna according to claim 1, the parasitic element being a conductive strip being attached to said dielectric support part.

5. An antenna according to claim 1, the matching circuit being a LTCC circuit, from the point of its manufacturing technology.

6. An adjustable multi-band antenna comprising:

a ground plane;

a radiating plane with a dielectric support part;

an adjusting circuit having a parasitic element electromagnetically coupled to in the radiating plane; and a controllable part reactive matching circuit connected to the parasitic element, the controllable part being configured to change a coupling between the parasitic element and the ground plane to displace an operation band of the antenna;

said controllable part being a reactive matching circuit, circuit values of which have been arranged to be chosen from at least two alternatives to implement said change in the coupling, and each alternative set of the circuit values comprises values of at least two reactive elements to optimize an impedance matching and efficiency of the antenna;

wherein, to choose said circuit values, the matching circuit comprises a switch and at least two reactive circuits having different circuit values, one reactive circuit at a time being connected to said parasitic element depending on state of the switch.

7. An antenna according to claim 6, said reactive element in said parallel circuit, being a coil.

8. An adjustable multi-band antenna comprising:

a ground plane;

a radiating plane with a dielectric support part:

an adjusting circuit having a parasitic element electromagnetically coupled to in the radiating plane; and a controllable part connected to the parasitic element, the controllable part being configured to change a coupling between the parasitic element and the ground plane to displace an operation band of the antenna;

said controllable part being a reactive matching circuit, circuit values of which have been arranged to be chosen from at least two alternatives to implement said change in the coupling, and each alternative set of the circuit values comprises values of at least two reactive elements to optimize an impedance matching and efficiency of the antenna;

wherein, to choose said circuit values, the matching circuit comprises at least one capacitance diode, a control voltage of which is arranged to be chosen from at least two alternatives.

9. An antenna according to claim 8, said reactive element in the parallel circuit, being a first capacitance diode with and a first capacitor in series in the same branch, and said capacitor in another branch being a second capacitance diode and a second capacitor in series.

10. A radio device having an adjustable multi-band antenna, which comprises:

a ground plane;

a radiating plane with a dielectric support part;

an adjusting circuit having a parasitic element electromagnetically coupled in the radiating plane; and a controllable part connected to the parasitic element, the controllable part being configured to change a coupling between the parasitic element and the ground plane to displace an operation band of the antenna;

said controllable part being-a comprising at least one reactive matching circuit, which constitutes a parallel circuit one branch of which comprises a reactive element and another branch a capacitive and inductive element in series to optimize an impedance matching and efficiency of the antenna, circuit values of which controllable part being arranged to be chosen from at least two alternatives to implement said change in the coupling.

* * * * *

UNITED STATES PATENT AND TRADEMARK OFFICE

CERTIFICATE OF CORRECTION

PATENT NO. : 7,468,700 B2
APPLICATION NO. : 11/008447
DATED : December 23, 2008
INVENTOR(S) : Zlatoljub Milosavljevic It is certified that error appears in the above-identified patent and that said Letters Patent is hereby corrected as shown below:

Title page Item [75] in the Inventor:

Please remove “Milosavlejevic” and insert --Milosavljevic--

Signed and Sealed this

Tenth Day of March, 2009

JOHN DOLL
*Acting Director of the United States Patent and Trademark Office*